US008968015B2

(12) United States Patent
Chang

(10) Patent No.: US 8,968,015 B2
(45) Date of Patent: Mar. 3, 2015

(54) SAFETY SOCKET

(71) Applicant: Chi-Tsai Chang, Taichung (TW)

(72) Inventor: Chi-Tsai Chang, Taichung (TW)

( * ) Notice: Subject to any disclaimer, the term of this patent is extended or adjusted under 35 U.S.C. 154(b) by 196 days.

(21) Appl. No.: 13/792,052

(22) Filed: Mar. 9, 2013

(65) Prior Publication Data

US 2014/0227902 A1 Aug. 14, 2014

(30) Foreign Application Priority Data

Feb. 8, 2013 (TW) ..... 102202991 U

(51) Int. Cl.
*H01R 29/00* (2006.01)
*H01R 13/639* (2006.01)

(52) U.S. Cl.
CPC ..... *H01R 13/639* (2013.01)
USPC ..... 439/140; 439/135; 439/345; 439/352

(58) Field of Classification Search
USPC ..... 439/135–141, 345, 352
See application file for complete search history.

(56) References Cited

U.S. PATENT DOCUMENTS

| | | | | |
|---|---|---|---|---|
| 6,083,054 | A * | 7/2000 | Suzuki et al. | 439/699.2 |
| 6,213,804 | B1 * | 4/2001 | Matsumura | 439/267 |
| 6,234,827 | B1 * | 5/2001 | Nishio et al. | 439/357 |
| 6,500,028 | B1 * | 12/2002 | Higuchi | 439/607.37 |
| 7,249,976 | B1 * | 7/2007 | Watson | 439/651 |
| 7,722,380 | B1 * | 5/2010 | West et al. | 439/373 |
| 8,714,995 | B2 * | 5/2014 | Chang | 439/345 |
| 8,727,817 | B2 * | 5/2014 | D'Hiver et al. | 439/789 |
| 8,758,034 | B1 * | 6/2014 | Shotey et al. | 439/140 |

* cited by examiner

*Primary Examiner* — Truc Nguyen

(57) ABSTRACT

A safety socket includes a main body, a restraint mechanism and a release mechanism. The restraint mechanism includes an immovable end and a movable end. The immovable end is disposed in the main body. The movable end has a through hole. The through hole corresponds in position to one of insertion holes of the main body. The movable end has an annular protruding portion axially extending from the wall of the through hole. The annular protruding portion has a free end which is curved outward. The safety socket can prevent a plug from being disengaged from the socket by accident. The outer surface of the conductive pin of the plug won't be scraped and damaged by the wall of the through hole to enhance the service life and safety of the plug.

5 Claims, 7 Drawing Sheets

SAFETY SOCKET

BACKGROUND OF THE INVENTION

1. Field of the Invention

The present invention relates to a socket, and more particularly, to a safety socket which can prevent a plug from being disengaged from the socket by accident.

2. Description of the Prior Art

A conventional safety socket uses a restraint mechanism to prevent a plug from being disengaged from the socket by accident. The restraint mechanism has a through hole. The wall of the through hole has acute corners at two open ends thereof. The conductive pins of the plug are made of a conductive metal. The conductive pins of the plug may be scraped by the two acute corners at the two open ends of the wall of the through hole when inserted in or pulled out of the through holes to cause so some metallic bits and pieces. After a period of time, a bad contact may happen to result in sparking to start a wire fire. It is necessary to improve the plug to be plugged in the socket securely. Accordingly, the inventor of the present invention has devoted himself based on his many years of practical experiences to solve this problem.

SUMMARY OF THE INVENTION

The primary object of the present invention is to provide a safety socket which can prevent the conductive pins of a plug from being scraped and damaged by a restraint mechanism when inserted in or pulled out of the socket.

In order to achieve the aforesaid object, the safety socket of the present invention comprises a main body, a restraint mechanism and a release mechanism.

The main body has an end surface. The end surface of the main body is formed with a plurality of insertion holes for insertion of a plurality of conductive pins of a plug.

The restraint mechanism comprises an immovable end and a movable end. The immovable end is disposed in the main body. The movable end is disposed at one end of the immovable end. The movable end has a through hole. The through hole corresponds in position to one of the insertion holes. The movable end has an annular protruding portion axially extending from the wall of the through hole. The annular protruding portion has a free end which is curved outward.

The release mechanism is movably connected to the main body and brings the movable end of the restraint mechanism to switch to an engaging position or a release position. The movable end of the restraint mechanism tends to move to the engaging position at any time. When the movable end of the restraint mechanism is located at the engaging position, one of the conductive pins of the plug is restrained by the movable end of the restraint mechanism so that the plug is unable to disengage from the main body by accident. When the movable end of the restraint mechanism is located at the release position, the conductive pins of the plug are able to be inserted in or pulled out of the insertion holes.

Accordingly, the safety socket of the present invention uses the restraint mechanism to prevent disengagement of the plug so as to avoid power failure of the machine connected with the plug to prevent any accident. Secondly, the wall of the through hole has arc corners (namely, the free end of the annular protruding portion) at two open ends thereof. When the movable end of the restraint mechanism is located at the release position, one of the conductive pins of the plug can be inserted in or pulled out of the through hole smoothly. The outer surface of the conductive pin won't be scraped and damaged by the wall of the through hole to enhance the service life and safety of the plug.

DETAILED DESCRIPTION OF THE PREFERRED EMBODIMENTS

Figure 1:
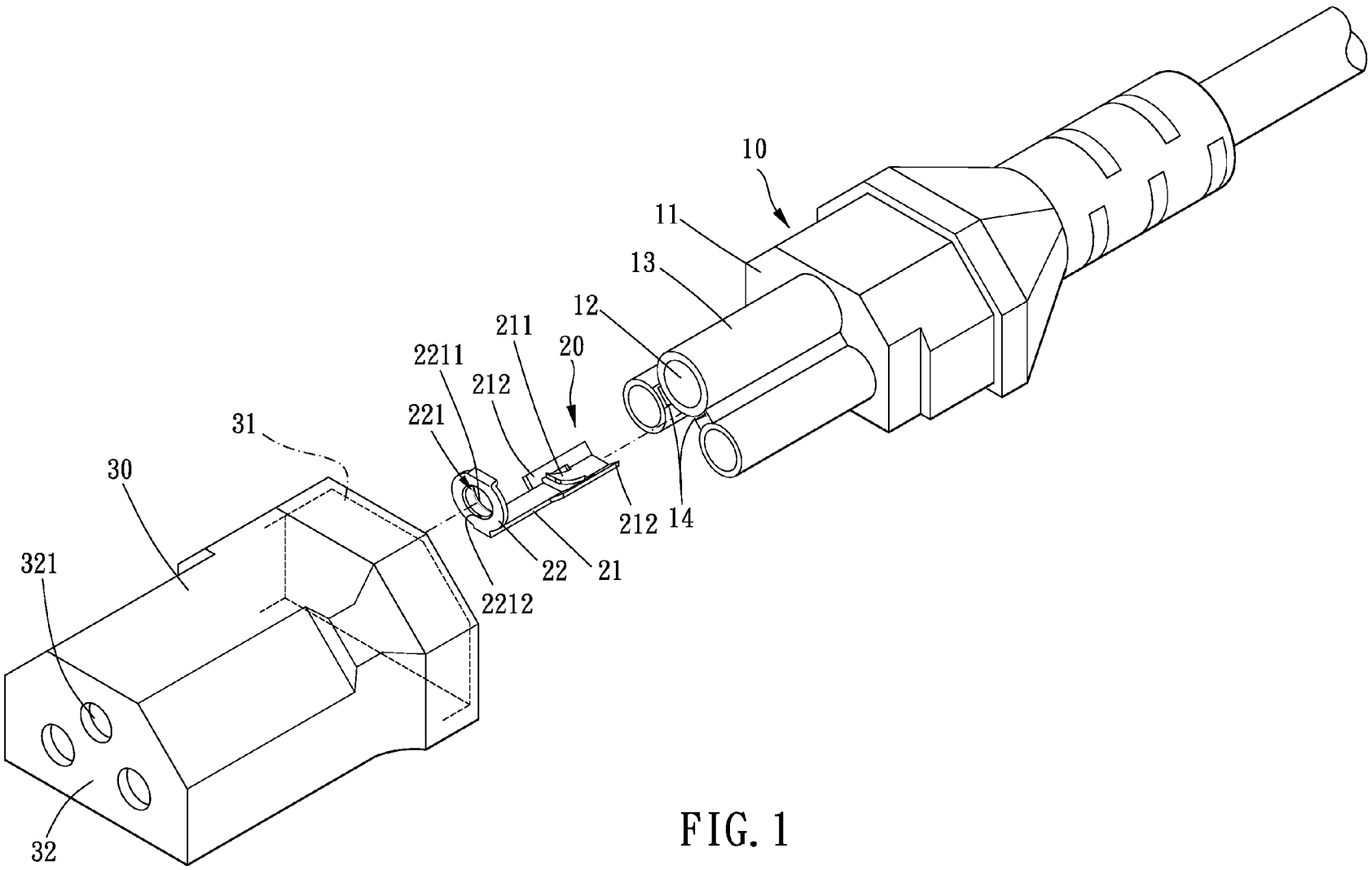
FIG. 1 is an exploded view according to a first embodiment of the present invention.
Figure 2:
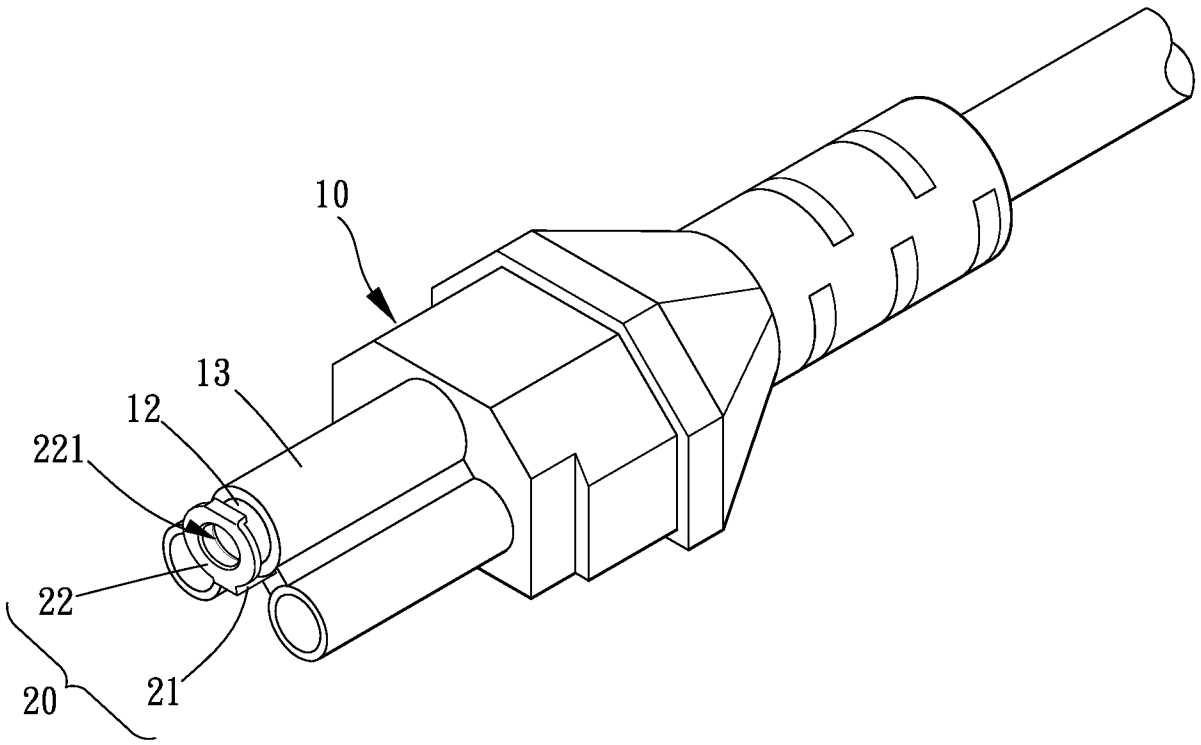
FIG. 2 is a perspective view showing the restraint mechanism coupled to the main body according to the first embodiment of the present invention.

Embodiments of the present invention will now be described, by way of example only, with reference to the accompanying drawings.

As shown in FIG. 1 to FIG. 4, the safety socket according to a first embodiment of the present invention comprises a main body 10, a restraint mechanism 20 and a release mechanism 30.

The main body 10 has an end surface 11 at one end thereof and an electric wire which is integrally formed with another end of the main body 10. This embodiment is a wire socket. The end surface 11 is provided with a plurality of insertion posts 13. In general, there are two or three insertion poles 13. This embodiment has three posts 13 as an example. Each post 13 has an insertion hole 12 and a conductive plate 121 in the insertion hole 12. The insertion holes 12 are adapted for insertion of a plurality of conductive pins 41 of a plug 40. The insertion posts 13 have a cylinder shape and the insertion holes 12 also have a cylinder shape for insertion of cylindrical conductive pins of the plug. The shape of the insertion posts 13 is designed to conform to the shape of the conductive pins 41, not limited to the aforesaid. Preferably, the middle insertion post 13 has an engaging slot (not shown) at a bottom side thereof. The other two posts 13 each have a positioning slot 14 at an inner side thereof.

The restraint mechanism 20 comprises an immovable end 21 and a movable end 22. The immovable end 21 is disposed in the main body 10. The immovable end 21 is provided with an inlay block 211 and two insertion sheets 212. The two insertion sheets 212 are located at two sides of the immovable end 21. The inlay block 211 of the immovable end 21 is engaged in the engaging slot. The two insertion sheets 212 are inserted in the two positioning slots 14. The immovable end 21 is inserted and fixed to the bottom side of the middle insertion pole 13. The movable end 22 is disposed at one end of the immovable end 21. The junction of the movable end 22 and the immovable end 21 is curved so the restraint mechanism 20 has an L-like shape. The movable end 22 has a through hole 221. The through hole 221 corresponds in position to the insertion hole 12 of the middle insertion pole 13. In this embodiment, the through hole 221 is a circular hole. The movable end 22 has an annular protruding portion 2211 axially extending from the wall of the through hole 221. Preferably, the movable end 22 comprises an inner side 222 and an outer side 223. The inner side 222 of the movable end 22 faces the end surface 11 of the main body 10. To make definite, the inner side 222 of the movable end 22 is more close to the end surface 11 of the main body 10 than the outer side 223 of the movable end 22. The annular protruding portion 2211 is close to the inner side 222 of the movable end 22 and axially extends toward the end surface 11 of the main body 10. The annular protruding portion 2211 has a free end which is curved outward. The wall of the through hole 221 and the outer side 223 of the movable end 22 form an intersection angle 2212 which is an arc angle. In other words, the wall of the through hole 221 has arc corners at two open ends thereof. In other embodiments, the annular protruding portion 2211 is close to the outer side 223 of the movable end 22 and axially extends far away the end surface 11 of the main body 10. The wall of the through hole 221 and the inner side 222 of the movable end 22 form an intersection angle 2212 which is an arc angle.

The release mechanism 30 is movably connected to the main body 10 and brings the movable end 22 of the restraint mechanism 20 to switch to an engaging position or a release position. The movable end 22 of the restraint mechanism 20 tends to move to the engaging position at any time. In this embodiment, the release mechanism 30 is a cover. The cover has a trough 31 at one end thereof and a closed surface 32 at another end thereof. The closed surface 32 is formed with a plurality of holes 321 corresponding to the insertion holes 12. The holes 321 communicate with the trough 31. The main body 10 is inserted in the trough 31, as shown in FIG. 1.

As shown in FIG. 1 to FIG. 4, the restraint mechanism 20 is protected by the release mechanism 30. The hole 221 corresponds to the middle hole 321. A distance is defined between the closed surface 32 and the end surface 11 of the main body 10 to form a movement area 50.

When the conductive pins 41 are plugged in the main body 10, the release mechanism 30 will be moved rearward toward the main body 10. The closed surface 32 is to press the movable end 22 of the restraint mechanism 20 to close the movement area 50. The holes 321 are aligned to the through hole 22 and the insertion holes 12 so that the conductive pins 41 of the plug 40 can be inserted in the insertion holes 12 smoothly. The conductive pins 41 of the plug 40 are contact with the conductive plates 121 of the main body 10 for electricity conduction. The release mechanism 30 is released, and the closed surface 32 disengages from the movable end 22. The movable end 22 is returned by its elasticity to an inclined state to form the movement area 50 relative to the end surface 11, so that the closed surface 32 and the end surface 11 are kept a distance therebetween. At this time, the movable end 22 of the restraint mechanism 20 is located at the engaging position. One of the conductive pins 41 of the plug 40 is restrained by the movable end 22 of the restraint mechanism 20, so that the plug 40 cannot be disengaged from the main body 10 by accident, as shown in FIG. 3 and FIG. 3A.

Figure 3:
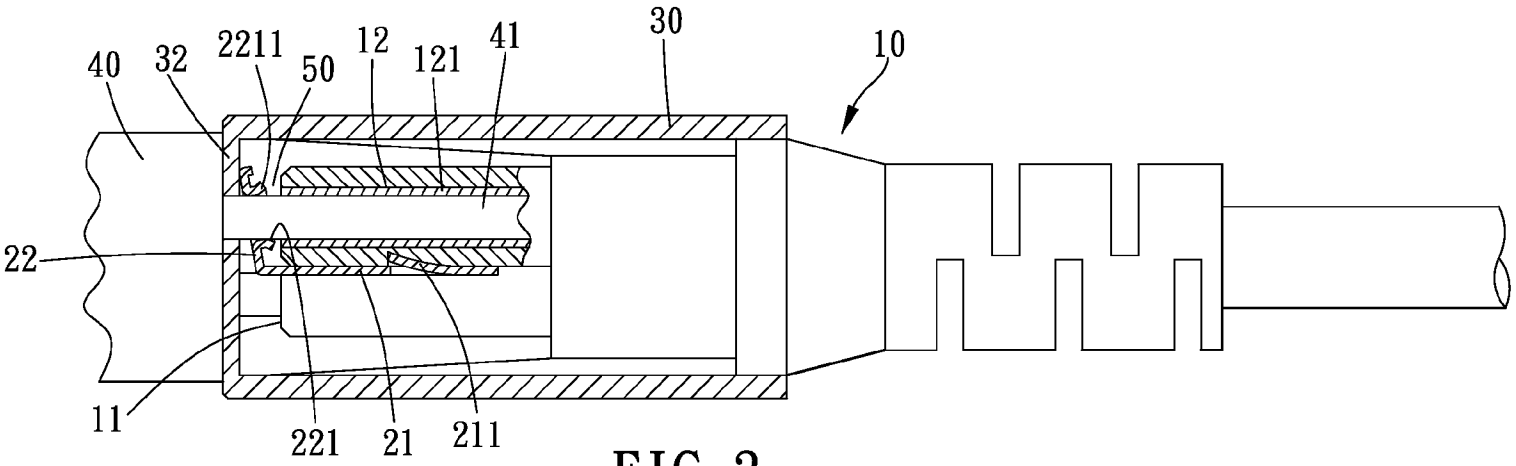
FIG. 3 is a sectional view showing the plug restrained by the restraint mechanism according to the first embodiment of the present invention.
Figure 4:
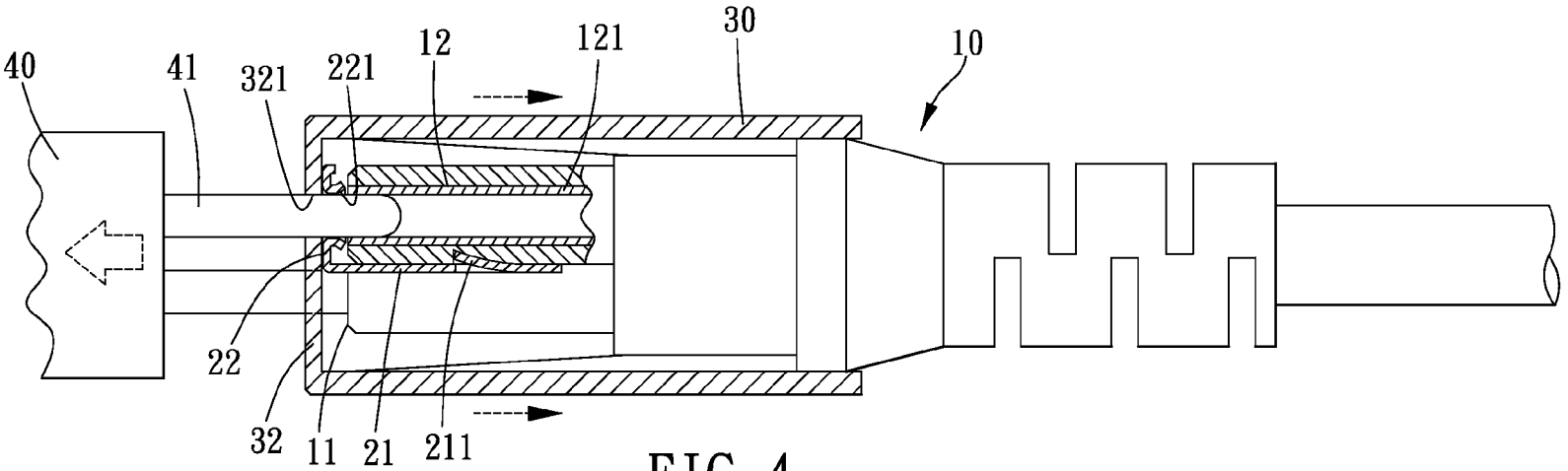
FIG. 4 is a sectional view showing the plug released by the restraint mechanism according to the first embodiment of the present invention.
Figure 3A:
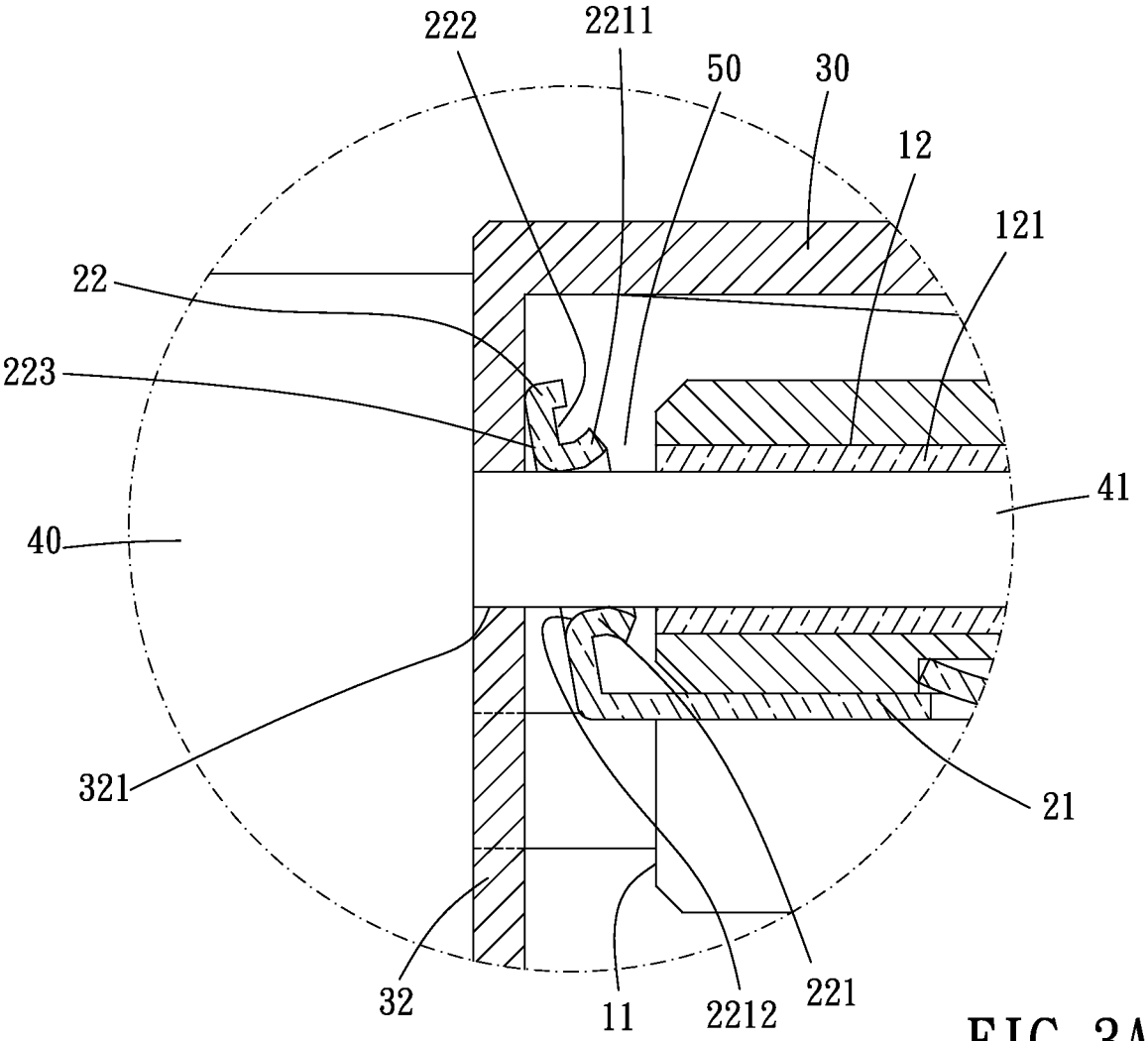
FIG. 3A is an enlarged view of FIG. 3.
Figure 5A:
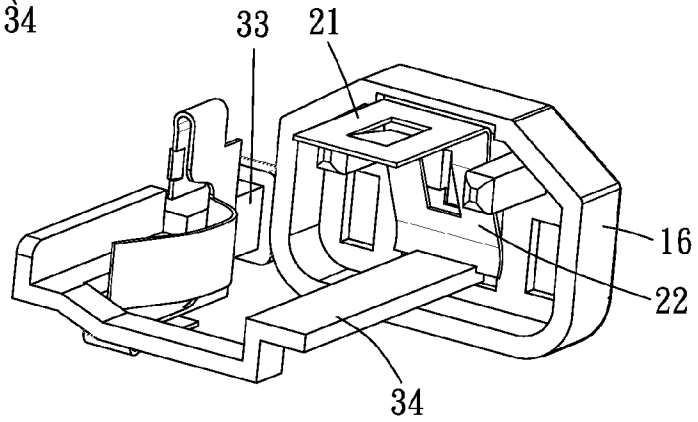
FIG. 5A is a perspective view showing the inner casing according to the second embodiment of the present invention.
Figure 5:
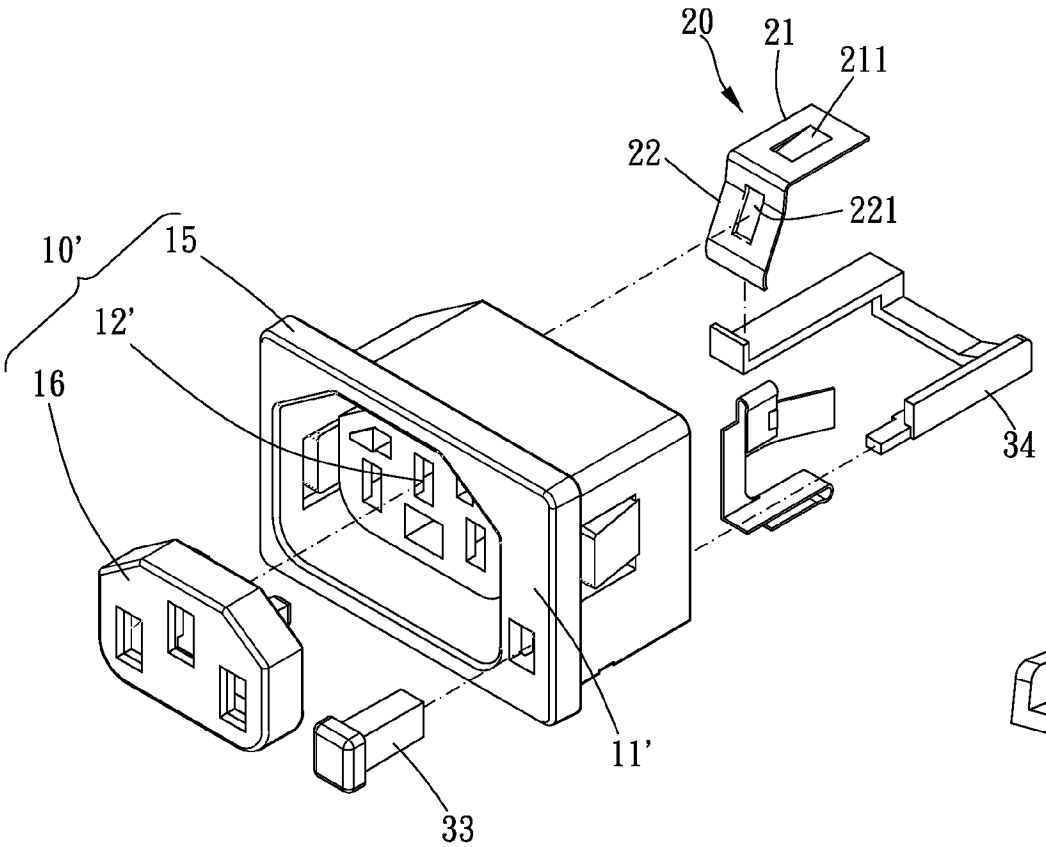
FIG. 5 is an exploded view according to a second embodiment of the present invention.
Figure 7:
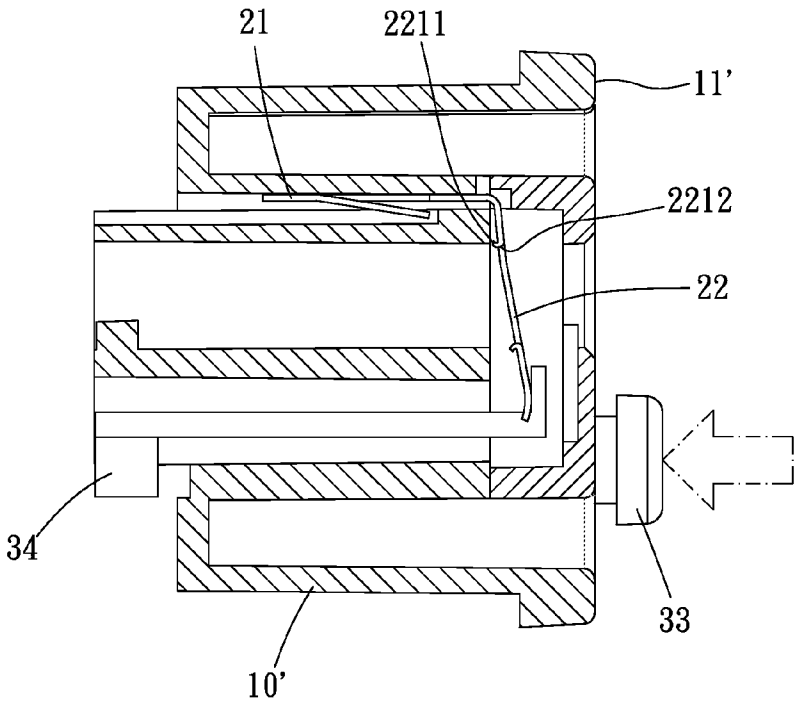
FIG. 7 is a sectional view showing the plug released by the restraint mechanism according to the second embodiment of the present invention.
Figure 6:
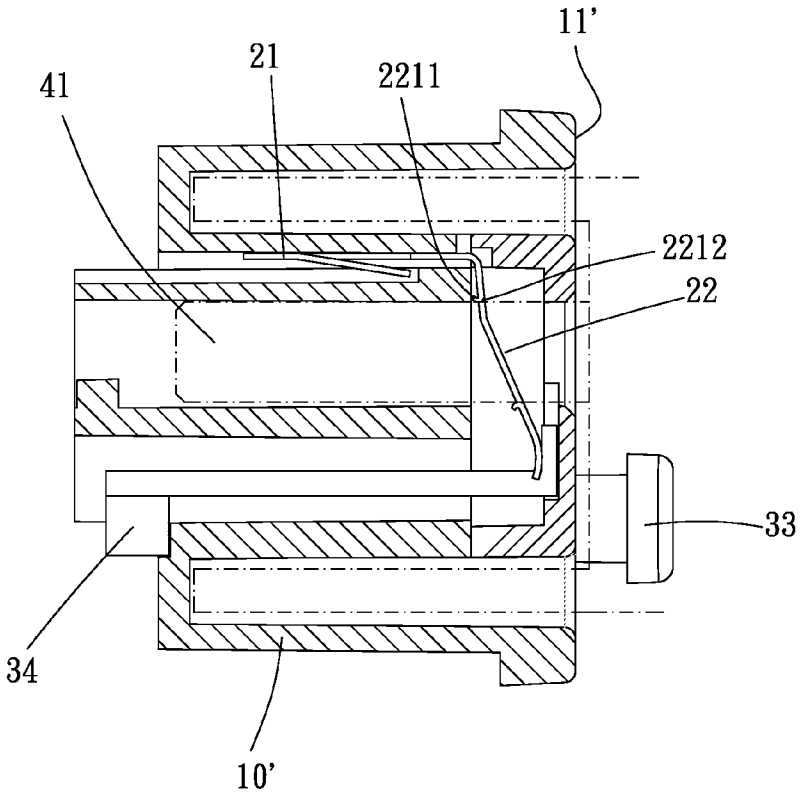
FIG. 6 is a sectional view showing the plug restrained by the restraint mechanism according to the second embodiment of the present invention.
Figure 8:
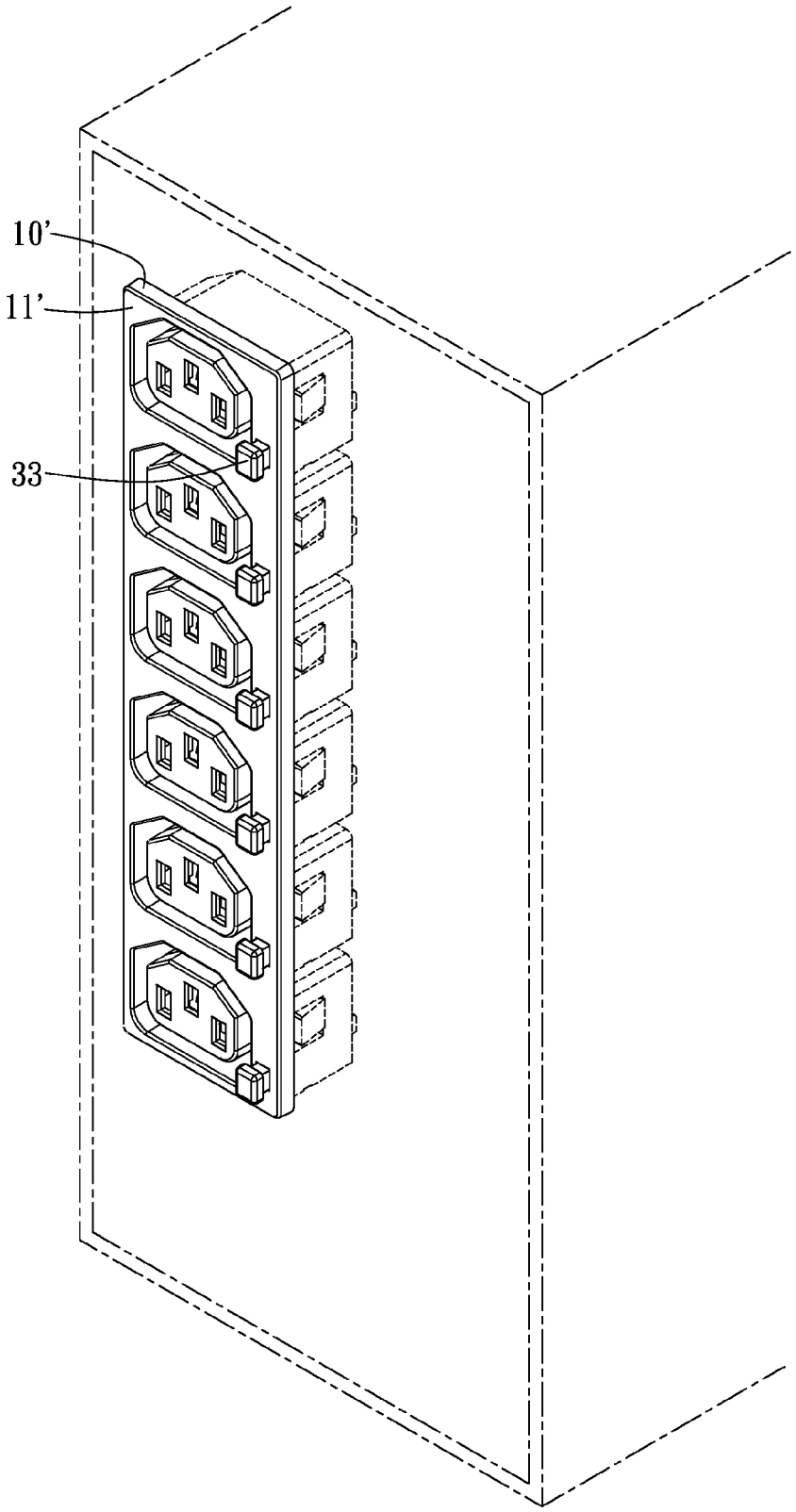
FIG. 8 is a schematic view showing the second embodiment of the present invention installed to a system machine.

Referring to FIG. 4, when the user wants to unplug the plug 41 from the present invention, the release mechanism 30 is pressed to press the movable end 22 to close the movement area 50, as shown in FIG. 3. The holes 321 are aligned to the through hole 22 and the insertion holes 12. At this time, the movable end 22 of the restraint mechanism 20 is located at the release position so that the conductive pins 41 of the plug 40 can be disengaged from the insertion holes 12 and the conductive plates 121 to pull out the plug.

Referring to FIG. 5 to FIG. 8, a second embodiment of the present invention is substantially similar to the first embodiment with the exceptions described hereinafter. The main body 10' is a normal socket, without the electric wire. The end surface 11' of the main body 10' doesn't have the insertion posts 13. The end surface 11' of the main body 10' is formed with a plurality of insertion holes 12'. The through hole 221 of the movable end 22 is a rectangular hole. Preferably, the main body 10' is composed an outer casing 15 having a panel and an inner casing 16. The outer casing 15 and the inner casing 16 are assembled. Furthermore, the release mechanism comprises a button 33 and a link rod 34. The button 33 vertically protrudes out of the end surface for the user to press thereon. When the button 33 is pressed, the link rod 34 will be moved. The link rod 34 hooks the free end of the movable end 22, such that the link rod 34 is moved to bring the movable end 22 and the restraint mechanism is switched to the release position. Preferably, the button 33 and the link rod 34 are slidably counted to in the main body 10'. The release mechanism 20 defines a slide direction. The slide direction is perpendicular to the end surface 11'. Besides, the link rod 34 has a holding surface at one side thereof. In other embodiments of the present invention, the button 33 may be buckled, connected or adhered to the link rod 34 or in other way.

Accordingly, the safety socket of the present invention uses the restraint mechanism 20 to prevent disengagement of the plug 40 so as to avoid power failure of the machine connected with the plug 40 to prevent any accident. Secondly, the wall of the through hole 221 has arc corners at two open ends thereof. When the movable end 22 of the restraint mechanism 20 is located at the release position, one of the conductive pins 41 of the plug 40 can be inserted in or pulled out of the through hole 221 smoothly. The outer surface of the conductive pin 41 won't be scraped and damaged by the wall of the through hole 221 to enhance the service life and safety of the plug 40.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A safety socket for a plug, the plug comprising a plurality of conductive pins, the safety socket comprising:

a main body having an end surface, the end surface of the main body being formed with a plurality of insertion holes for insertion of the plurality of conductive pins of the plug;

a restraint mechanism comprising an immovable end and a movable end, the immovable end being disposed in the main body, the movable end being disposed at one end of the immovable end, the movable end having a through hole, the through hole corresponding in position to one of the insertion holes, the movable end having an annular protruding portion axially extending from a wall of the through hole, the annular protruding portion having a free end which is curved outward; and a release mechanism movably connected to the main body and bringing the movable end of the restraint mechanism to switch to an engaging position or a release position, the movable end of the restraint mechanism tending to move to the engaging position, wherein when the movable end of the restraint mechanism is located at the engaging position, one of the conductive pins of the plug is restrained by the movable end of the restraint mechanism so that the plug is unable to disengage from the main body by accident; wherein when the movable end of the restraint mechanism is located at the release position, the conductive pins of the plug are able to be inserted in or pulled out of the insertion holes.

2. The safety socket as claimed in claim 1, wherein the movable end comprises an inner side and an outer side, and the annular protruding portion is close to the inner side of the movable end and axially extends toward the end surface of the main body.

3. The safety socket as claimed in claim 2, wherein the wall of the through hole and the outer side of the movable end form an intersection angle which is an arc angle.

4. The safety socket as claimed in claim 1, wherein the movable end comprises an inner side and an outer side, and the annular protruding portion is close to the outer side of the movable end and axially extends far away the end surface of the main body.

5. The safety socket as claimed in claim 4, wherein the wall of the through hole and the inner side of the movable end form an intersection angle which is an arc angle.

* * * * *